US006471186B1

(12) United States Patent
Lawless

(10) Patent No.: US 6,471,186 B1
(45) Date of Patent: Oct. 29, 2002

(54) ERGONOMIC HANDLE PRY BAR

(75) Inventor: John C. Lawless, Charlemont, MA (US)

(73) Assignee: Mayhew Steel Products, Inc., Shelburne Falls, MA (US)

( * ) Notice: Subject to any disclaimer, the term of this patent is extended or adjusted under 35 U.S.C. 154(b) by 0 days.

(21) Appl. No.: 10/000,750

(22) Filed: Oct. 24, 2001

(51) Int. Cl.[7] ..... B25C 11/00
(52) U.S. Cl. ..... 254/25; 29/267; 29/235
(58) Field of Search ..... 254/25; 29/267, 29/278, 270; 81/177.1, 177.4, 177.8, 438, 439, 490, 489; 16/111 R, 110 R, DIG. 12, DIG. 19

(56) References Cited

U.S. PATENT DOCUMENTS 1,130,147 A * 3/1915 Coles ..... 29/278
1,888,222 A * 11/1932 Curtis et al. ..... 81/177.1
4,240,192 A * 12/1980 Davis ..... 29/278
4,451,024 A * 5/1984 Shepard ..... 254/104
5,475,894 A * 12/1995 Wildforster ..... 81/177.1
5,495,651 A * 3/1996 Tsuha ..... 29/235
5,797,918 A * 8/1998 McGuire et al. ..... 29/278
5,832,791 A * 11/1998 Lin ..... 81/177.1
6,094,780 A * 8/2000 McGlothin et al. ..... 16/430
6,209,428 B1 * 4/2001 Anderson et al. ..... 81/490

* cited by examiner

*Primary Examiner*—Lee D. Wilson
(74) *Attorney, Agent, or Firm*—Lackenbach Siegel LLP

(57) ABSTRACT

The pry bar has an ergonomic handle with a convex upper grip surface and a concave lower grip with an inner hard thermoplastic core and an outer elastomeric molded over cover, with the pry bar metal shank having an angularly disposed pry end. The curved upper grip surface portion is more distant from the handle longitudinal axis than the curved lower grip surface portion. The upper grip surface is formed with a distally disposed elastomeric ribbed thumb receiving recess. The handle sides are formed with elongated outwardly bulging palm engaging portions.

26 Claims, 3 Drawing Sheets

ERGONOMIC HANDLE PRY BAR

BACKGROUND OF THE INVENTION

This invention relates to pry bars and pry bar handles. Specifically, this invention relates to an ergonomic handle pry bar. This invention also relates to a pry bar screwdriver.

BACKGROUND AND DISCUSSION OF THE PRIOR ART

In general, pry bars were of all metal construction and were cumbersome to grip and use. Often the user had to grip a rectilinear metal portion of the pry bar.

It was generally known to provide an elastomeric molded around cover on a molded hard thermoplastic core for improved grip for knives, screwdrivers, and the like bladed tools. Such prior art constructions are disclosed in Sanelli, U.S. Pat. No. 4,712,304; Gakhar, U.S. Pat. No. 5,390,572; Hoepfl, U.S. Pat. No. 5,964,009; and Panaccione, U.S. Pat. No. 5,956,799.

The pry bar art desired an improved handle so as to provide improved grip with ergonomic functionality.

It is therefore a principal object of the present invention to provide an ergonomic handle pry bar.

It is another object of the present invention to provide an improved grip pry bar handle.

It is still another object of the present invention to provide a handle as aforesaid with a screwdriver function.

The aforesaid inventive aspects alone and in combination provide an ergonomic handle pry bar construction.

It is still another object of the present invention to provide a pry bar with multiple diverse functionality.

SUMMARY OF THE INVENTION

A pry bar ergonomic handle has a longitudinal axis and an upper convex surface and a lower concave surface and outwardly disposed elongated bulge portions, and a recess formed int eh distal end of the upper surface to receive the thumb, wherein the grip hand engages the upper and lower surface with the left or right palm engaging one of the bulges, for ergonomic feel in heavy duty pry bar use. The thumb recess is formed with a plurality of parallel ribs to engage the thumb. A distal end guard protects the thumb and other fingers from sliding forward.

The handle has a hard thermolastic core and an integrally molded elastomeric corner. The corner is particularly fully curves the thumb engaging recess and ribs and the elongated side bulges.

In the heavy duty embodiment the shank is a screwdriver as opposed tot he pry bar. The screwdriver shank is coaxial that the drive force is accurately transmitted tot he screwdriver edge.

DESCRIPTION OF THE PREFERRED EMBODIMENTS

Figure 1:
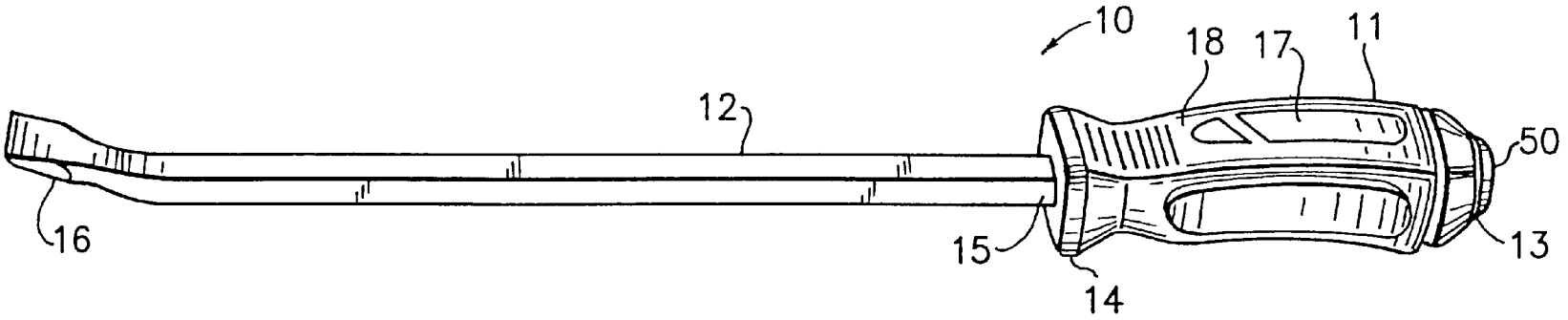
FIG. 1 is a perspective view of the pry bar embodiment of the present invention.

Referring to FIGS. 1, 3–9, there is shown pry bar 10 of the present invention. Pry bar 10, in general terms, includes handle 11 and a fixedly attached metal bar or shank 12. Handle 11 has a proximate end 13 and a distal end 14. Shank 12 has a proximate end 15 and a distal end 16. Handle 11 is formed of a hard thermoplastic molded core 17 and a molded around integrally bonded elastomeric soft grip cover 18, wherein cover 18 is formed of relatively soft elastomeric material.

The proximate end 13 of shank 12 is securely fixedly molded in core 17, with the formation of core 17. The elastomeric cover 18 is then molded over or around the core, by means well known in the knife, screwdriver, and like bladed hand tool handle prior art.

Figure 4:
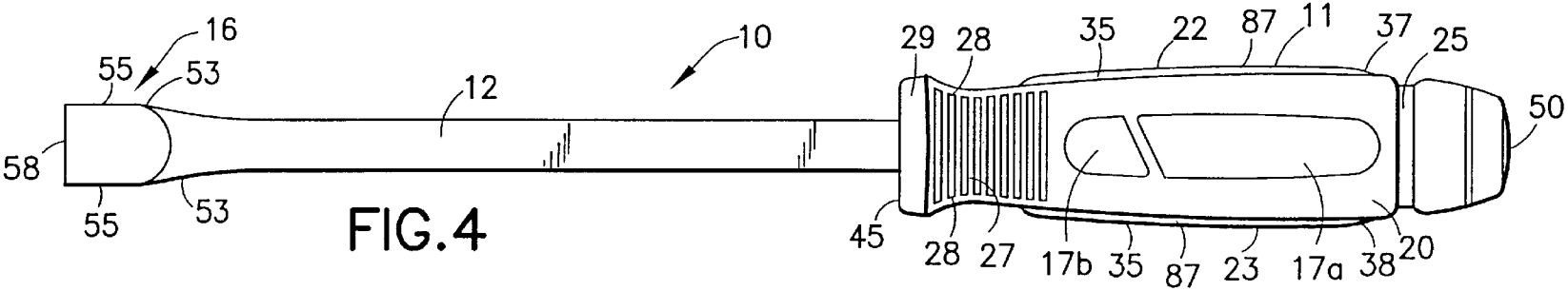
FIG. 4 is a top plan view of the pry bar as shown in FIG. 3.
Figure 6:
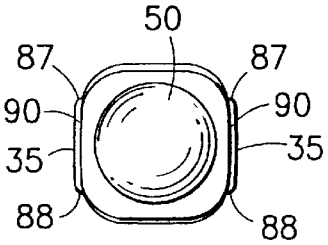
FIG. 6 is a proximate end view of the pry bar as shown in FIG. 5.
Figure 5:
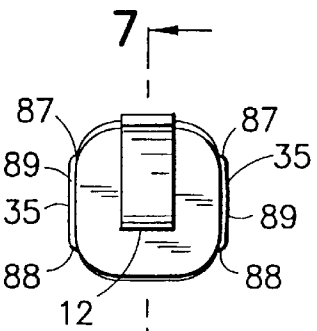
FIG. 5 is a distal end view of the pry bar as shown in FIG. 4.

Handle 11 has an upper surface 20 and oppositely disposed lower surface 21, and oppositely disposed sides 22 and 23. Upper surface 26 has a proximate fustro-conical portion 24, groove 25, convex upwardly disposed grip portion 26, a thumb receiving recess 27 formed with a plurality of parallel ribs 28, and a raised distal end portion thumb guard 29. Lower surface 21 is formed with a proximate portion 30, groove 25, concave upwardly disposed grip portion 32, index finger receiving recess 33, and distal end portion or index guard 34. Handle 11 has an elongated axis A. Upper grip portion 26 is further disposed from axis A than lower grip portion 32. Each handle side 22 and 23 has an outwardly or protruding element or bulge portion 35. The sides 22 and 23 are tapered outwardly in the proximate direction as at 37 and 38, as best shown in FIG. 4.

Each side protruding surface or bulge 35 is elongated and has a convex elongated upper edge 87, a concave elongated lower edge 88, and opposed curvilinear pr arcuate ends 89 and 90. The elongated bulges 35, particularly in combination with the afore-described upper and lower contoured surfaces 20 and 21, provides an improved ergonomic handle wherein the user's right or left hand and particularly the palm has improved ergonomic feel and affect in pry bar use.

Thumb receiving recess 27 and forefinger receiving recess 28 are oppositely disposed in their respective upper and lower grip surfaces. The distal guard portions 29, 34, 65 and 66, are contiguous to form a distally disposed guard 45. Guard 45 protects the thumb and forefinger from sliding off the handle in pry bar use, regardless of the manner in which the handle is equipped.

A metal impact cap 50 is fixedly disposed at the distal end of the handle 11 Cap 50 is secured within the handle core 17 by means well known in the screwdriver handle art. Cap 50 is used for example, to impact screw heads prior to driving same, as will be further explained hereinafter.

Figure 7:
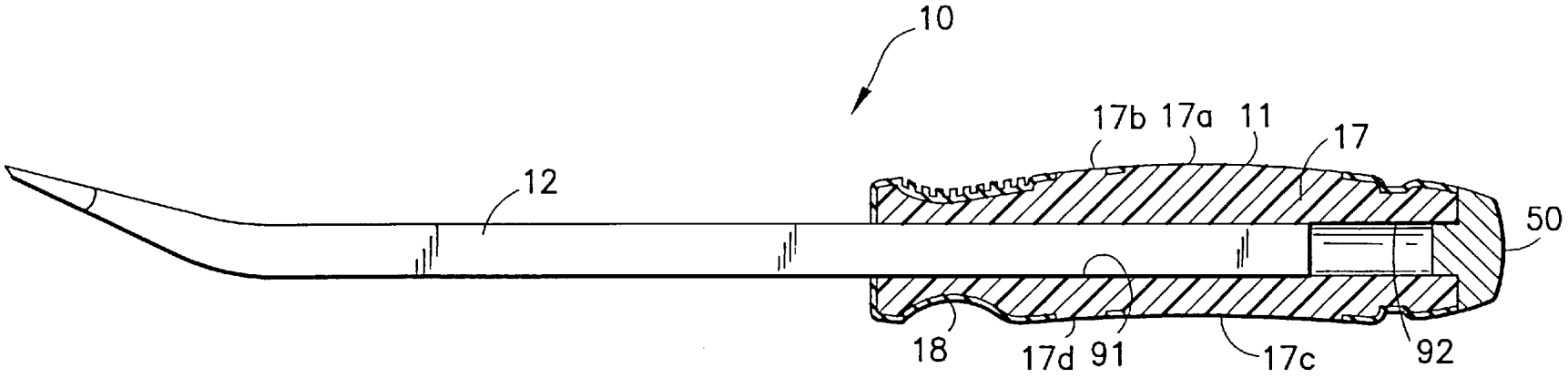
FIG. 7 is a sectional view taken along line 7—7 of FIG. 5.
Figure 9:
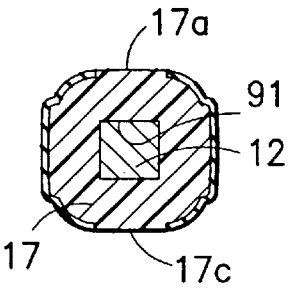
FIG. 9 is a sectional view taken along line 9—9 of FIG. 3.
Figure 8:
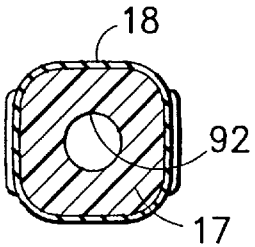
FIG. 8 is a sectional view taken along line 8—8 of FIG. 3.

In molding handle core 17 around shank 12 a rectilinear hole 91 is formed in the handle distal end. The proximate end of core 17 is however formed with a circular cylindrical hole 92 for fixedly holding metal cap 50 (FIGS. 7–9).

Shank 12 is of square cross-sectional construction and has a proximate end 15 and a distal end 16. Proximate end 15 is molded in situ with core 17, so as to be fixedly secured within handle 11, by means well known in the art.

Distal end 16 is formed with a pry end 53. Pry end 53 has outwardly tapered sides 54, and parallel sides 55, and upper and lower surfaces 56 and 57. Surfaces 56 and 57 are tapered and extend towards sharpened edge or tip 58. Tip 58 is upwardly angularly disposed with respect to shank 12.

In the aforesaid manner of construction, there is provided a ergonomic pry bar and handle. In use, the user grips handle 11 so that the thumb is received in recess 27 and frictionally engages ribs 28, and the thumb is retained in place on ribs 28 by distal guard 45.

The user's palm is disposed on the upper grip surface, and one of the side bulges or surfaces (depending upon whether the user is right or left handed), with the fingers generally engaging the oppositely disposed side bulge 35. The forefinger is received in ribbed recess 27 and is retained therein by distal guard 45. The user then uses the pry bar with comfort and reduced fatigue as compared with conventional construction pry bars.

The elastomeric cover 18 does not cover the entire core 17. Upper surface areas 17*a* and 17*b* and lower surface areas 17*c* and 17*d* are uncovered. These areas 17*a*–17*d* are defined for permanently imprinting the manufacturers name and for ornamental and aesthetic purposes. (FIGS. 4 and 7).

The core may be formed of hard thermoplastic using and the cover may be formed of wft elastomeric material well known in the hand tool handle art.

The afore-discussed handle surfaces and contours, and in conjunction with the pry bar configuration and disposition with respect to the handle, provides an ergonomic pry bar.

Figure 2:
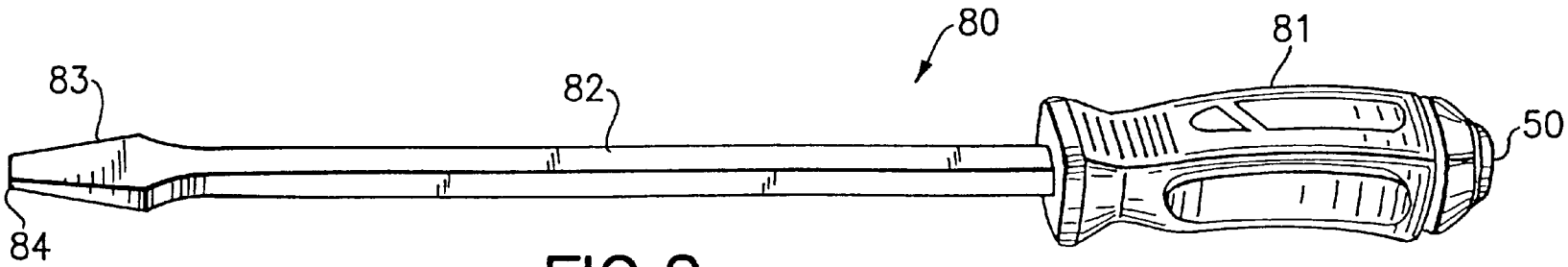
FIG. 2 is a perspective view of the screwdriver embodiment of the present invention.
Figure 3:
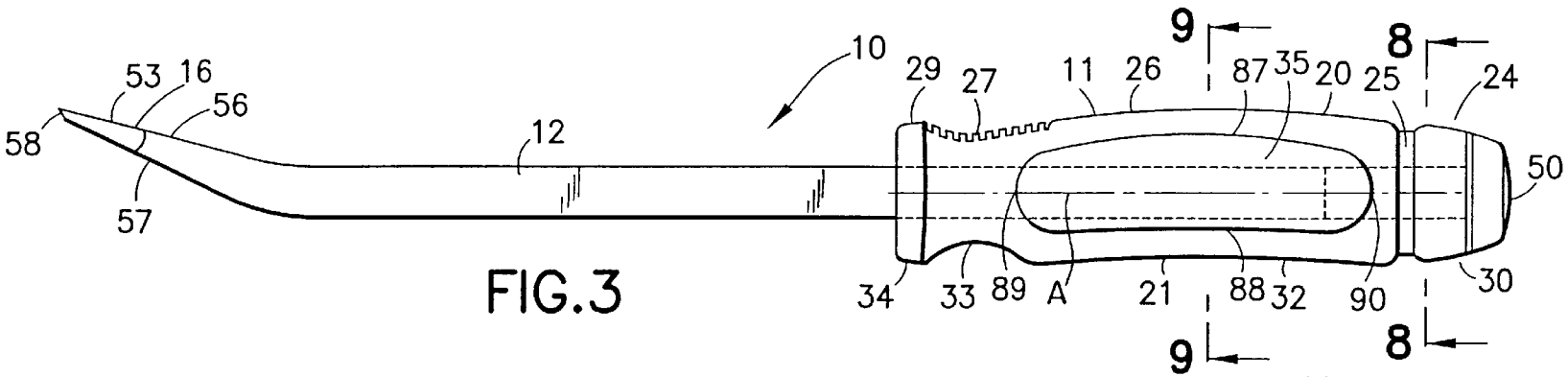
FIG. 3 is a side elevational view of the pry bar of FIG. 1.

Referring to FIG. 2, there is shown the screwdriver embodiment 80 of the present invention. Screwdriver 80 has ergonomic handle 81 which is identical in construction to handle 17. Shank 82 is formed at into distal end 83 with a conventional flat blade screwdriver edge 84. In this manner of construction ergonomic handle 81 is used as a screwdriver handle. It is within the contemplation of the present invention that black edge 84 be used to pry open can lids and the like pry uses cap 85 may be used to impact and position screws handle for driving the edge 84.

The invention contemplates an ergonomic handle for both pry bar and heavy duty screwdriver use.

While the foregoing describes certain embodiments of the invention, various modifications and changes may be made within the spirit and scope of the invention, as defined by the adjoined claims.

What is claimed is:

1. A pry bar comprising:

a handle having a distal end, a proximate end and having a grip portion of generally rectilinear cross-section and comprising a convex curved upper grip surface and a concave curved lower grip surface disposed directly below the convex upper grip surface, said handle comprising an inner thermoplastic core and outer integrally bonded elastomeric cover, a shank, said shank having a proximate end and a distal end, said shank proximate end being secured within said handle, said shank being elongate and having a longitudinal axis, said handle distal end being formed with a pry end, said pry end being in angular disposition with respect to said shank longitudinal axis.

2. The pry bar of claim 1, said upper grip surface being convex with respect to said handle longitudinal axis, and extending from about said handle proximate end to said handle distal end.

3. The pry bar of claim 2, said lower grip surface being upwardly curved concave with respect to said handle longitudinal axis and extending from about said proximate end to said distal end.

4. The pry bar of claim 3, said upper grip surface being further disposed from said handle longitudinal access than said lower grip surface.

5. The pry bar of claim 4, said core being harder than said cover.

6. the pry bar of claim 1, said handle having opposed sides and said sides being formed with elongated outwardly protruding bulges for engaging the user's palm.

7. The pry bar of claim 6, said sides having an upper convex edge and a lower concave edge.

8. The pry bar of claim 1, said pry working end having a sharpened edge.

9. The pry bar of claim 1, said upper grip surface elastomeric cover being formed with a distally disposed downwardly curved recess having a plurality of ribs for engaging a user's thumb.

10. The pry bar of claim 1, said handle elastomeric cover having opposed sides and said sides being formed with elongated outwardly protruding bulges for engaging the user's palm.

11. The handle of claim 1, further comprising a metal impact cap disposed at the proximate end.

12. A pry bar comprising:

a handle having a distal end and a proximate end and a grip portion having a generally rectilinear cross-section and comprising an upper grip surface and a lower grip surface disposed directly below the upper grip surface, and a longitudinal axis extending from said distal end to said proximate end, said upper grip surface being convex with respect to said longitudinal axis, and said upper grip surface being further disposed from said handle longitudinal axis than said lower grip surface, and a shank, said shank having a proximate end and a distal end, said proximate end being fixedly secured within said handle, said shank being elongate and having a longitudinal axis, said shank distal end being formed with a pry end, said pry end being angularly disposed with respect to said shank longitudinal axis.

13. The pry bar of claim 12, said handle comprising a thermoplastic inner core and an elastomeric integrally bonded cover.

14. The pry bar of claim 12, said handle having oppositely disposed sides, said being formed with an elongated bulge outwardly disposed, each said bulge being covered by an elastomeric cover.

15. the pry bar of claim 12, said sides being tapered outwardly from the handle proximate end.

16. The pry bar of claim 12, further comprising a metal impact cap disposed at the proximate end.

17. A pry bar comprising:

a handle having a distal end and a proximate end and a convex upper grip surface and a concave lower grip surface, and a longitudinal axis extending from said distal end to said proximate end, said handle comprising an inner thermoplastic core and outer molded over elastomeric cover; and a shank, said shank having a proximate end and a distal end, said proximate end being secured within said handle, said shank being elongate and having a longitudinal axis, said shank distal end being formed with a pry end, said pry end being in angular disposition with respect to said shank longitudinal axis, and a metal impact cap disposed at said handle proximate end.

18. The pry bar of claim 17, said handle further comprising a thumb receiving recess disposed at the distal end of the upper grip surface.

19. The pry bar of claim 18, said thumb receiving recess having a plurality of ribs formed in said elastomeric cover and not in said thermoplastic core.

20. An ergonomic tool handle comprising;

means for holding a shank;

a grip portion having a generally rectilinear cross-section and comprising:

a convex upper grip surface;

a concave lower grip surface disposed directly below the convex upper grip surface;

a thumb receiving upper recess; and a forefinger receiving recessing lower recess;

wherein the thumb receiving recess is distally disposed from said from upper grip surface and the forefinger receiving recess is distally disposed from said lower grip surface.

21. The handle of claim 21, said handle having a longitudinal axis, and wherein said upper grip surface is more distant from said axis than said lower grip surface.

22. The handle of claim 21, said handle further comprising a hard thermoplastic core and an outer softer elastomeric integral cover.

23. The handle of claim 22, said thumb receiving recess comprises a plurality of ribs formed in said elastomeric cover and not in said thermoplastic core.

24. The handle of claim 20, said handle having oppositely disposed sides, each said side being formed with an elongated outwardly disposed bulge.

25. The handle of claim 24, said sides being tapered outwardly in the proximate direction.

26. The pry bar of claim 20, further comprising a metal impact cap disposed at the proximate end.

* * * * *